United States Patent [19]

Johnson

[11] 4,418,512

[45] Dec. 6, 1983

[54] MACHINE AND METHOD FOR MAKING SUBSTANTIALLY AIR-FREE SEALED POUCHES

[75] Inventor: Kenneth R. Johnson, Sarasota, Fla.

[73] Assignee: Rexham Corporation, New York, N.Y.

[21] Appl. No.: 247,253

[22] Filed: Mar. 25, 1981

[51] Int. Cl.[3] ..... B65B 31/00

[52] U.S. Cl. ..... 53/434; 53/512

[58] Field of Search ..... 53/403–408, 53/434, 510–512, 79, 86; 426/403, 407, 410, 412

[56] References Cited

U.S. PATENT DOCUMENTS

| | | | |
|---|---|---|---|
| 3,182,432 | 5/1965 | Canfield | 53/112 |
| 3,430,414 | 3/1969 | Ludwig et al. | 53/79 |
| 3,619,975 | 11/1971 | Johnson et al. | 53/112 B |
| 4,016,705 | 4/1977 | Wilson | 53/407 |
| 4,081,942 | 4/1978 | Johnson | 53/22 B |

*Primary Examiner*—A. J. Heinz

*Attorney, Agent, or Firm*—Leydig, Voit, Osann, Mayer & Holt, Ltd.

[57] ABSTRACT

Flexible pouches filled with product are advanced to a steaming station where steam from a steam nozzle is directed downwardly toward the pouches to drive air therefrom. A vacuum nozzle is inserted downwardly within the steam nozzle and into each pouch at the steaming station, the upper end portion of the pouch is closed around the nozzle and then a vacuum is drawn through the nozzle to evacuate the air in the pouch. The top of the pouch is sealed immediately after the vacuum nozzle is retracted out of the pouch and while steam is still being directed downwardly toward the pouch to prevent air from re-entering the pouch.

4 Claims, 6 Drawing Figures

MACHINE AND METHOD FOR MAKING SUBSTANTIALLY AIR-FREE SEALED POUCHES

BACKGROUND OF THE INVENTION

This invention relates to a packaging machine and to a method of filling flexible pouches with product, evacuating air from the filled pouches, and then sealing the pouches.

In the packaging of certain products, and particularly food products, the filled and sealed pouches are delivered to an autoclave or retort and are heated to high temperatures so as to sterilize the product in the pouches. In order for this packaging process to be successful, it is important that the sealed pouch be substantially free of air when the pouch is delivered to the autoclave. If any significant amount of air is present in the pouch, the air will expand when subjected to the high temperatures in the autoclave and will cause the pouch to balloon, such ballooning sometimes destroying the seals of the pouch. Even if the pouch is not subjected to autoclaving, it is often desirable to remove the air from the pouch so that the product will be packaged in an oxygen-free environment and will possess a long stable shelf life.

One known method of removing air from pouches is disclosed in Johnson U.S. Pat. No. 4,081,942 in which filled pouches are advanced beneath a steam nozzle and then are sealed while steam is being directed out of the nozzle and into the pouches. The steam purges the pouches of air and then condenses to create a vacuum in the pouches.

SUMMARY OF THE INVENTION

The general aim of the present invention is to provide a new and improved machine and method for removing air more effectively and more consistently from the pouches, and particularly relatively large pouches, when the pouches are being advanced at a comparatively high rate.

A more detailed object is to achieve the foregoing by evacuating the pouches with a vacuum nozzle which is inserted into and retracted from each pouch while the pouch is being subjected to a continuous downward flow of steam from a steam nozzle. The steam tends to purge the pouch of air before the vacuum nozzle is inserted into the pouch, facilitates the drawing of a vacuum in the pouch by the vacuum nozzle, and prevents air from entering the pouch as the vacuum nozzle is retracted out of the pouch.

The invention also resides in the unique disposition of the vacuum nozzle inside of the steam nozzle for up and down movement within the steam nozzle.

These and other objects and advantages of the invention will become more apparent from the following detailed description when taken in conjunction with the accompanying drawings.

DETAILED DESCRIPTION OF THE PREFERRED EMBODIMENT

Figure 1:
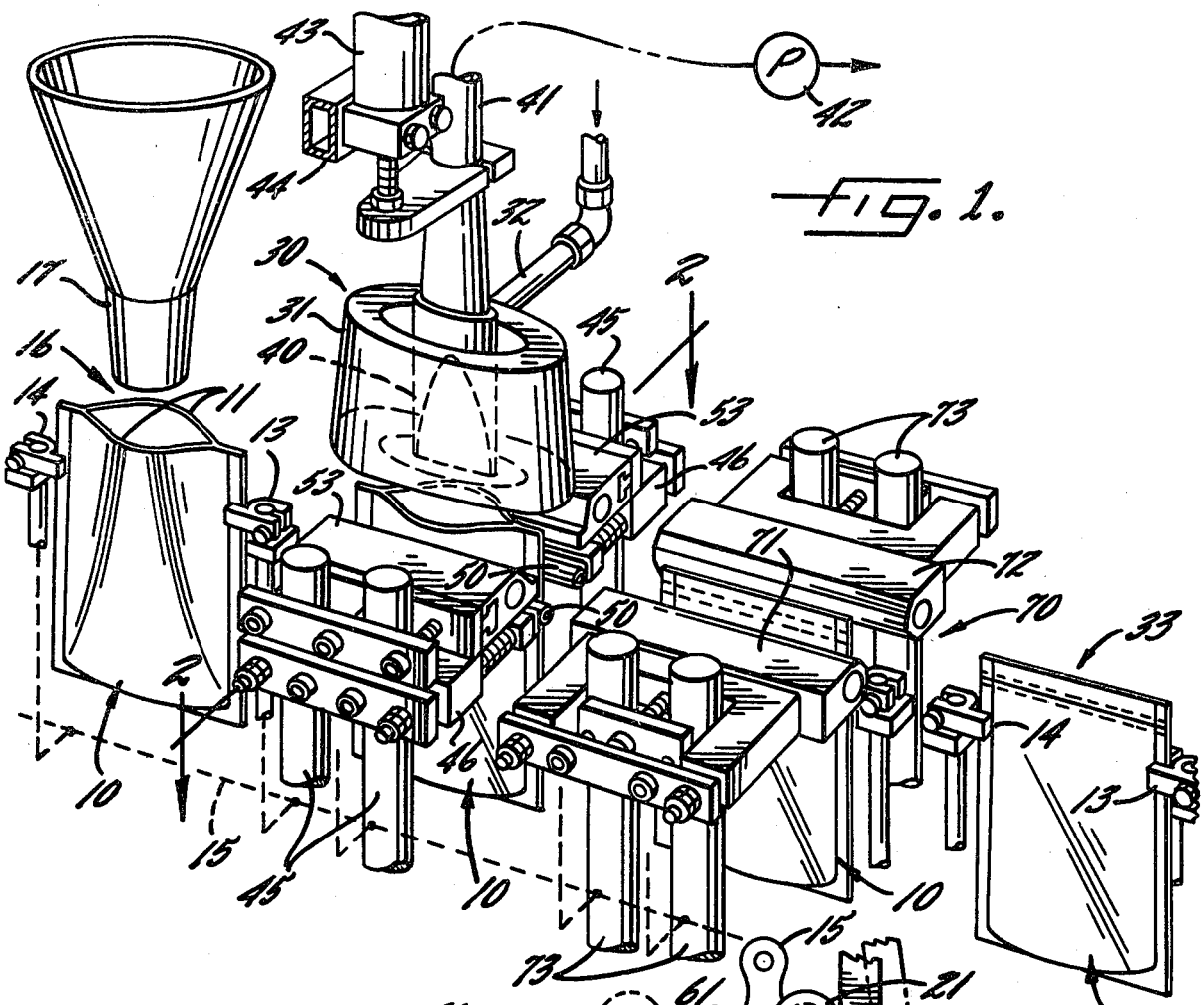
FIG. 1 is a fragmentary perspective view of a new and improved packaging machine incorporating the unique features of the present invention.

As shown in the drawings for purposes of illustration, the invention is embodied in a packaging machine for filling and sealing envelope-type pouches 10. Such a pouch usually is made from a single or composite sheet of flexible material having at least one side which is heat sealable. The pouch includes two flexible panels 11 which are sealed or otherwise joined together along their side and bottom margins, the upper end of the pouch being open until the pouch is filled and sealed.

Figure 2:
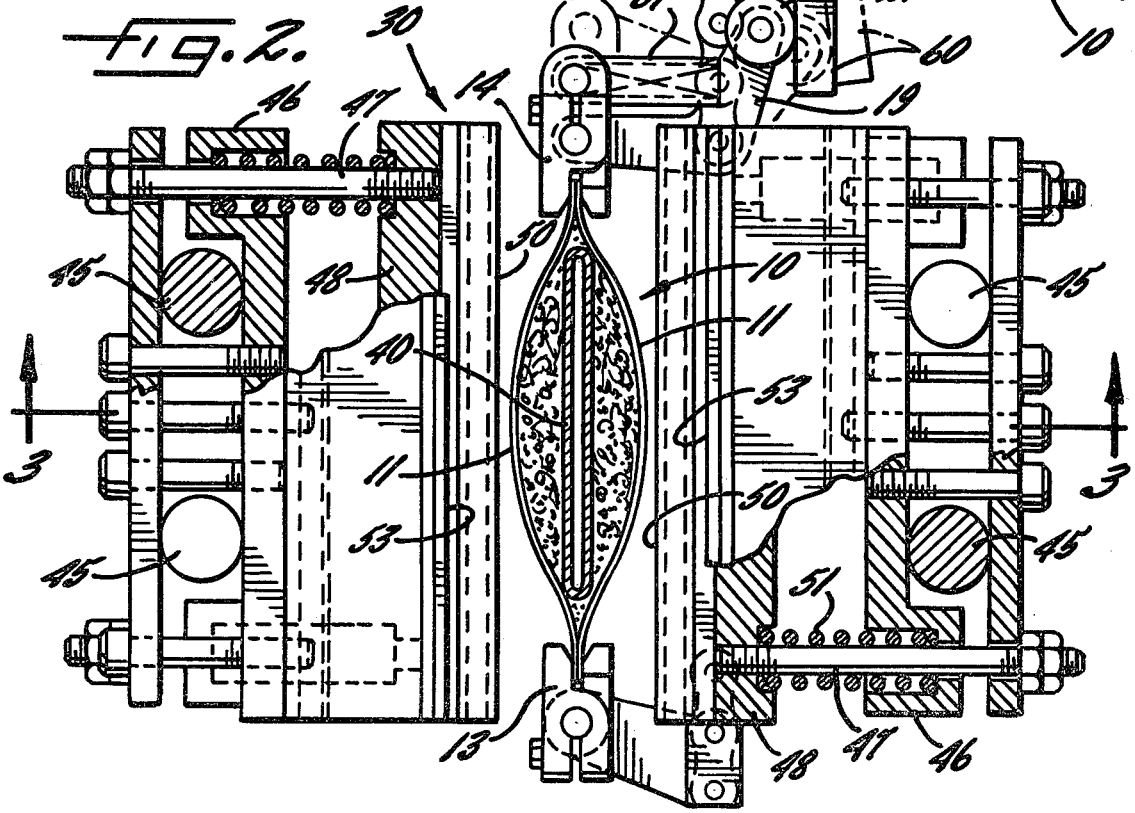
FIG. 2 is an enlarged cross-section taken substantially along the line 2—2 of FIG. 1 and showing certain parts of the machine.

In many respects, the packaging machine is similar to that disclosed in Johnson et al. U.S. Pat. No. 3,553,934 and thus certain elements of the machine need not be described in detail. It will suffice to say that each pouch 10 is adapted to be gripped releasably at its side margins by leading and trailing clamps 13 and 14 which are carried on a chain 15 (FIG. 2). The latter is adapted to be advanced intermittently by a drive mechanism (not shown) and, as the chain is advanced along a predetermined path, the pouches are moved into and momentarily dwell at a series of horizontally spaced stations where packaging operations are performed on the pouches. The pouches herein are advanced in spaced edgewise relation and are held with their open ends facing upwardly. In the present instance, the pouches are relatively large and have a capacity of, for example, from one to three liters.

Herein, the machine includes a filling station 16 (FIG. 1) having a dispenser spout 17 for depositing a product into each pouch 10 as the latter dwells beneath the spout. In one particular packaging operation, the product which is discharged through the spout is a particulate solid product such as peas which may be cold or slightly warm. To facilitate dispensing of the product into the pouch, the trailing clamp 14 is adapted to be shifted toward the leading clamp 13 and, when the trailing clamp is so shifted, it causes the panels 11 of the pouch to bow outwardly and open the upper end portion or mouth of the pouch as shown in FIGS. 1 and 2. In order to effect shifting of the trailing clamp 14, the latter is carried on a bellcrank 19 (FIG. 2) which is pivotally mounted at 20 on the chain 15. When the trailing clamp is located in the filling station 16, a stationary cam (not shown) engages a roller 21 on one arm of the bellcrank 19 and causes the latter to swing counterclockwise about the pivot 20 and thereby shift the trailing clamp toward the leading clamp 13 and effect opening of the pouch. For a more detailed disclosure of a shiftable bag clamp, reference may be had to Lense et al. U.S. Pat. No 3,568,402.

Figure 3:
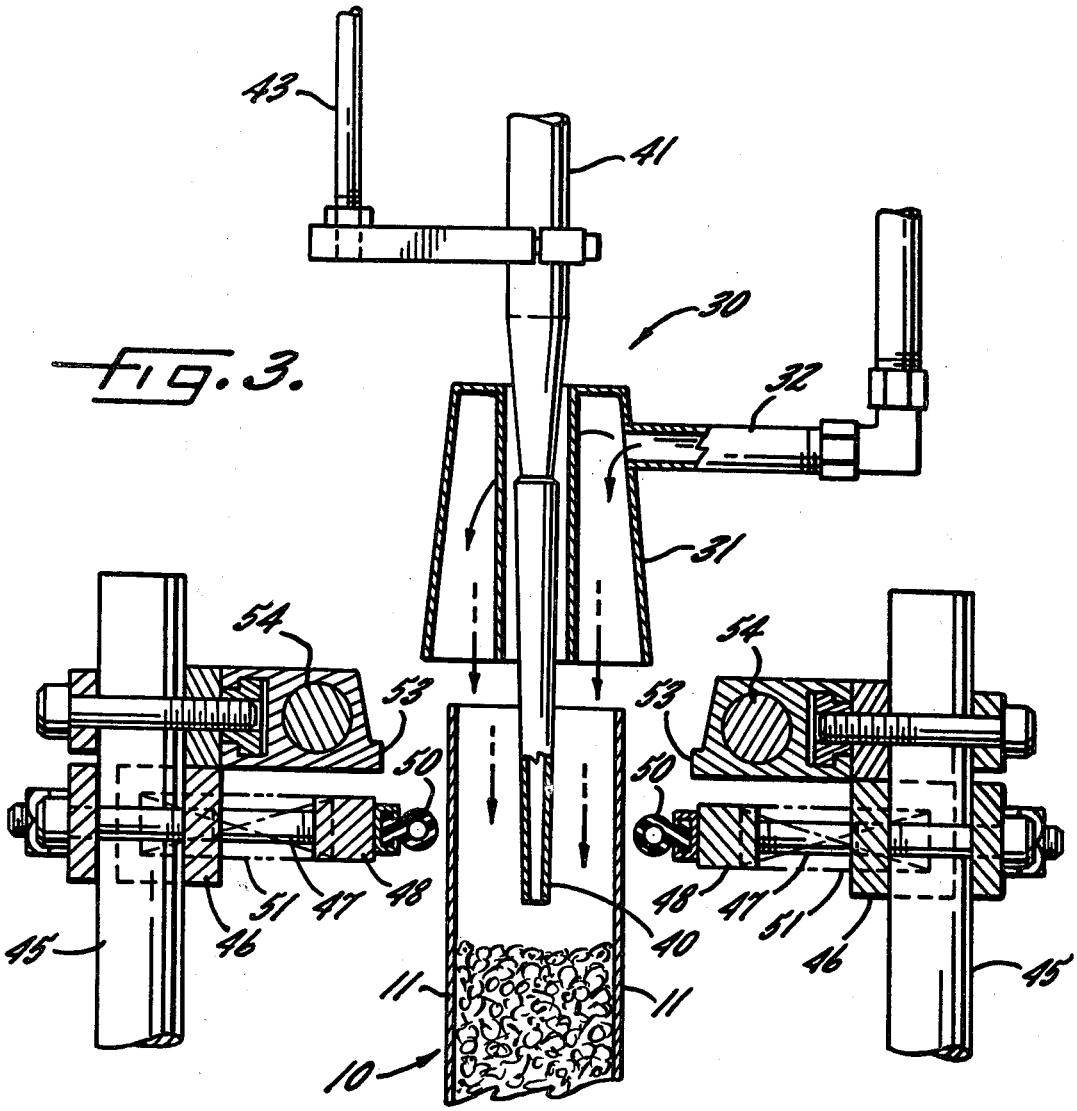
FIG. 3 is a fragmentary cross-section taken substantially along the line 3—3 of FIG. 2 and shows the vacuum nozzle inserted into the pouch.

After being filled, each pouch 10 advances to and dwells in a steaming station 30 where dry steam at a temperature of approximately 375 degrees F. and at a pressure of about 3 p.s.i. is introduced into the pouch through a nozzle 31 (FIGS. 1 and 3) when the pouch first dwells and while the upper end of the pouch is still held open by the trailing clamp 14. The steam drives air and gases out of the pouch for a purpose to be explained subsequently. As shown in FIGS. 1 and 3, the steam nozzle 31 is located just above the upper end of each pouch which dwells in the steaming station 30 and is of an elongated shape so as to discharge the steam across substantially the entire length of the mouth of the pouch. Steam is admitted continuously into the nozzle through a pipe 32.

After each pouch 10 is flushed with steam and is purged of air, its upper end portion is heat sealed and the pouch is advanced to a station 33 for removal from the clamps 13 and 14. The pouch is subsequently transferred to an autoclave (not shown) which is adapted to heat the pouch to a high temperature in order to sterilize the contents of the pouch. Any air which is in the pouch will expand when subjected to the heat of the autoclave and, if any significant amount of air is present in the pouch, it will cause the pouch to balloon excessively and may cause either the panels 11 or the seals to break. Also, the presence of oxygen in the pouch is detrimental to the shelf life of some products. Accordingly, it is important to remove air from the pouch and, in the present instance, this is partially achieved by introducing steam into the pouch at the steaming station 30. The steam drives some of the air out of the pouch and, upon condensing, creates a vacuum in the pouch.

In accordance with the present invention, air is more effectively removed from the pouch 10 by mechanically creating a vacuum in the pouch with a vacuum nozzle 40 while steam is being directed downwardly toward the pouch from the steam nozzle 31. When the pouch dwells in the steaming station 30, the vacuum nozzle 40 is inserted downwardly into the pouch, the upper end portion of the pouch is closed around the vacuum nozzle, and a vacuum is drawn through the vacuum nozzle to evacuate air from the pouch. Thereafter, the vacuum nozzle is retracted out of the pouch while the upper end portion of the pouch is still closed around the vacuum nozzle and, immediately after the vacuum nozzle has been retracted, the upper end portion of the pouch is closed. All of the foregoing steps are carried out while the pouch is subjected to a continuous downward flow of steam from the steam nozzle 31. I have discovered that purging of the pouch by using a combination of steam and mechanical vacuum results in more effective and more consistent removal of air than is the case when either is used alone and particularly when the pouches are advanced at a high rate.

In the preferred manner of carrying out the invention, the vacuum nozzle 40 is disposed within the steam nozzle 31 and is adapted to move upwardly and downwardly therein. The vacuum nozzle is substantially flat in shape and its upper end is connected to a pipe 41 (FIG. 1) which, in turn, is connected to a vacuum pump 42. To extend and retract the vacuum nozzle, a reciprocating pneumatic actuator 43 is connected between the pipe 41 and a fixed frame member 44. The actuator is operated in timed relation with the advance of the pouches 10 and is effective to shift the vacuum nozzle downwardly just after each pouch dwells in the steaming station 30 and to retract the vacuum nozzle upwardly out of the pouch before the pouch is advanced out of the steaming station.

In order to effect closing of the pouch 10, two upright rods 45 are located on each side of the pouch and are adapted to be moved toward and away from the pouch by conventional mechanism (not shown). Spanning each pair of rods is a mounting bar 46 (FIG. 3) which slidably receives two bolts 47. Attached to the inboard ends of each pair of bolts is a head 48 which carries a resiliently yieldable closing shoe 50. The shoes are adapted to close the upper end portion of the pouch 10 around the vacuum nozzle 40 and, in this instance, each shoe is made from a piece of rubber-like tubing having a length substantially equal to the width of the pouch. Coil springs 51 are telescoped over the bolts 47 and are compressed between the bars 46 and the heads 48 to urge the shoes 50 inwardly toward the pouch.

Preferably carried on the mounting bars 46 and located above the closing shoes 50 are two opposing sealing bars 53 which are equipped with heating elements 54. When the rods 45 are retracted outwardly, the sealing bars 53 are located outwardly of the closing shoes 50 as shown in FIG. 3 and, when the rods are shifted fully inwardly, the sealing bars engage the upper end portions of the side panels 11 of the pouch 10 to form a heat seal along the top of the pouch (see FIG. 6).

With the foregoing arrangement, each pouch 10 is advanced into the steaming station 30 while the closing shoes 50 and the sealing bars 53 are retracted away from the pouch as shown in FIGS. 2 and 3 and while the pouch is held in a widely open position by the bag clamps 13 and 14. As the pouch dwells and as steam is introduced into the pouch from the steam nozzle 31, the vacuum nozzle 40 is inserted downwardly within the steam nozzle and into the pouch 10 (see FIG. 3). Thereafter, the upper end portion of the pouch is closed by shifting the trailing bag clamp 14 away from the leading clamp 13 so as to draw the panels 11 of the pouch toward one another. To this end, a swingable bar 60 (FIG. 2) is located adjacent the upstream end of the steaming station 30. When each pouch first enters the station, the bar is positioned as shown in solid lines in FIG. 2 and engages the roller 21 of the trailing bag clamp 14 to keep that clamp shifted toward the leading clamp 13 and thus hold the pouch open. After the pouch has stopped in the steaming station for a short interval and has received the vacuum nozzle 40, the bar 35 is swung counterclockwise to the position shown in phantom lines in FIG. 2. As an incident to such swinging, a coil spring 61 forces the bellcrank 19 to turn clockwise about the pivot 20, the spring being compressed between the bellcrank and the trailing clamp 14. Clockwise turning of the bellcrank shifts the trailing clamp away from the leading clamp 13 to draw the panels of the pouch toward one another.

Figure 4:
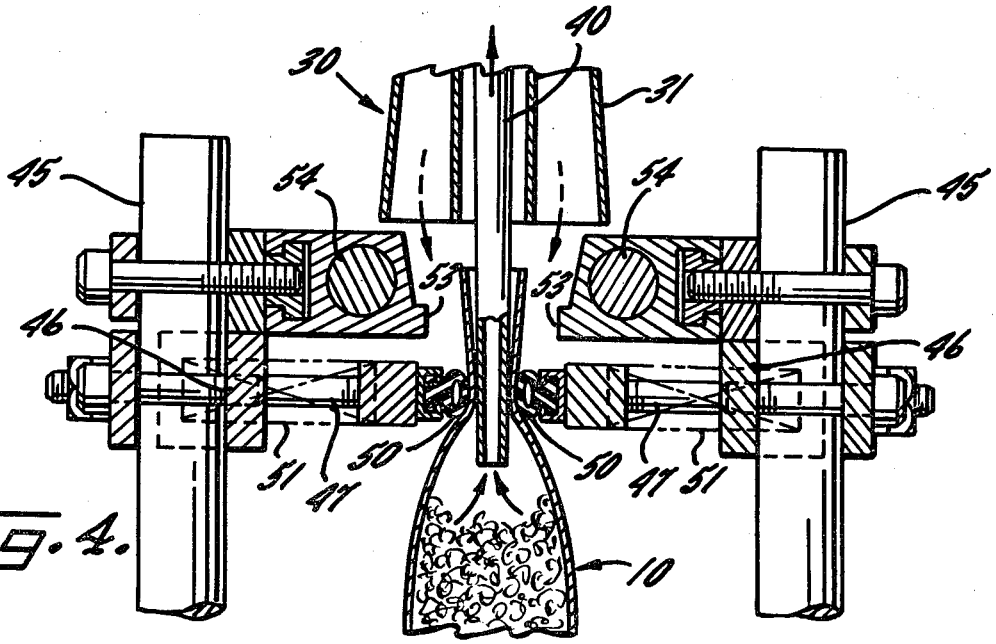
FIGS. 4, 5 and 6 are views similar to FIG. 3 but show subsequent steps which are followed in evacuating and sealing the pouch.

At about the same time the clamp 14 is shifted away from the clamp 13, the rods 45 are shifted inwardly to cause the closing shoes 50 to mechanically seal the upper end portion of the pouch around the vacuum nozzle 40 (see FIG. 4). Thus, the shoes 50 press the upper end portion of the pouch against the nozzle 40 and, as an incident thereto, the shoes compress as shown in FIG. 4. Once the shoes 50 have closed the pouch 10 around the nozzle 40, inward movement of the rods 45 is stopped momentarily to leave the sealing bars 53 spaced away from the pouch.

Figure 5:
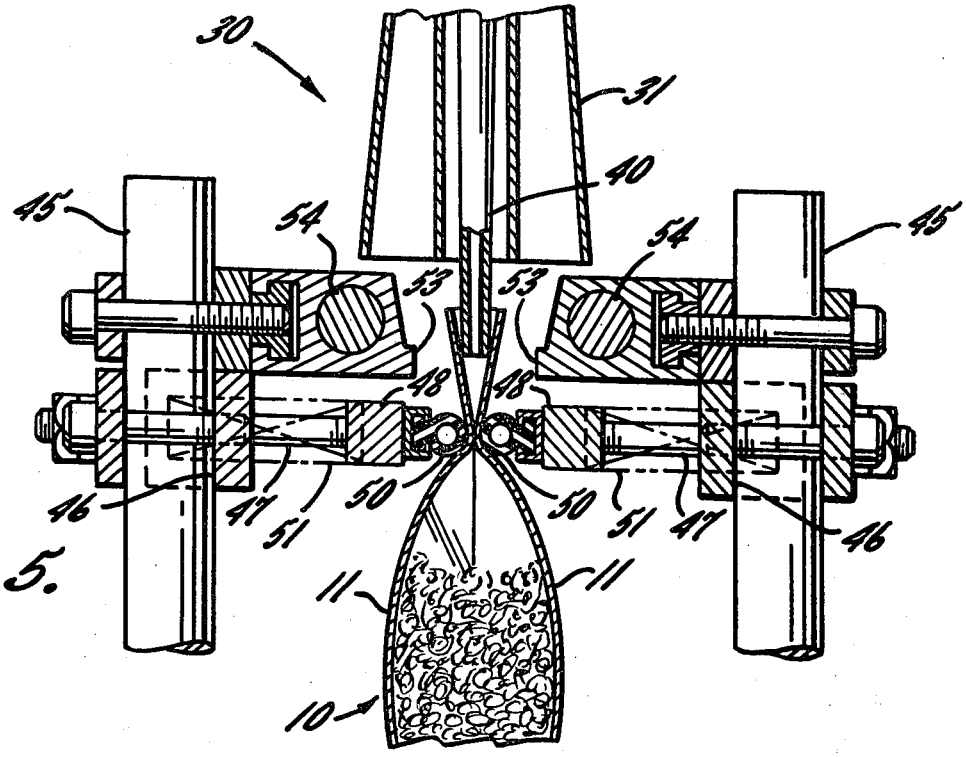

With the pouch 10 sealed mechanically around the nozzle 40 by the shoes 50, a vacuum is drawn through the nozzle 40 by the pump 42. Thus, the air in the pouch is evacuated through the nozzle 40. After a predetermined time period, the vacuum nozzle 40 is retracted upwardly out of the pouch and upwardly within the steam nozzle 31 (see FIG. 5). As the lower end of the vacuum nozzle 40 clears the compressed shoes 50, the latter spring inwardly and close the side panels 11 together (FIG. 5). In addition, the spring 61 shifts the trailing clamp 14 rearwardly a short additional distance as soon as the lower end of the nozzle 40 clears the upper end of the pouch. Thus, the clamp draws the pouch taut and coacts with the shoes 50 to hold the pouch closed.

Figure 6:
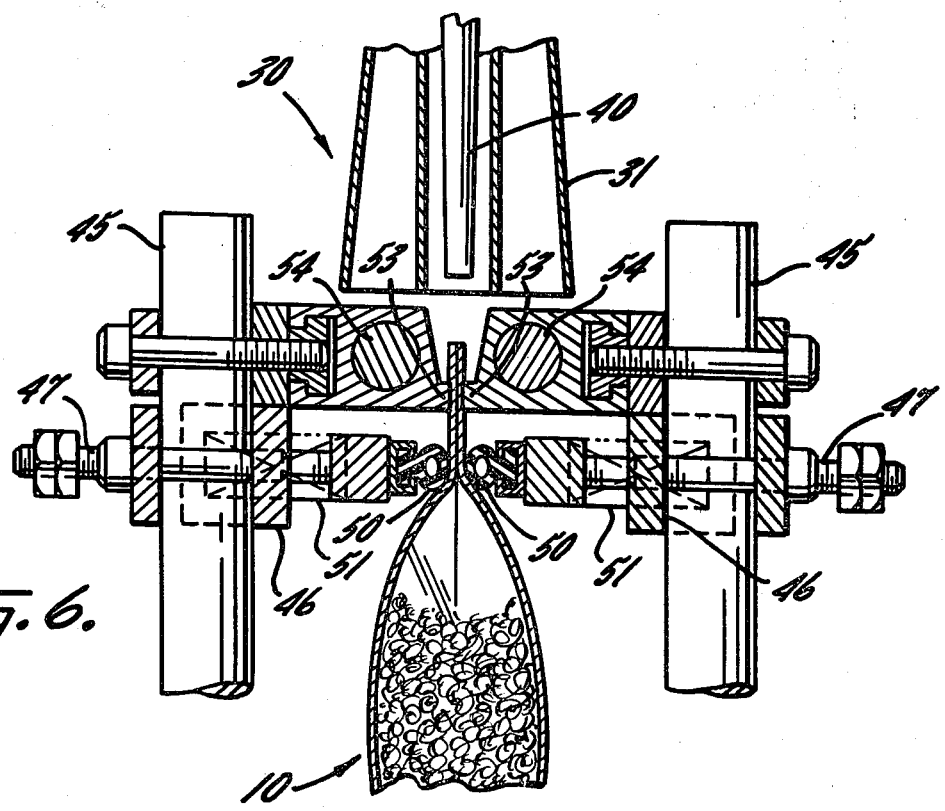

In the preferred embodiment of the invention, the rods 45 shift inwardly to bring the sealing bars 53 into engagement with the pouch 10 and seal the upper end thereof immediately after the vacuum nozzle 40 has been retracted from the pouch (FIG. 6). The springs 51 behind the shoes 50 compress to allow the bars 46 and 53 to move inwardly relative to the shoes during the sealing operation. After the seal has been formed, the rods 45 are retracted and the pouch then is advanced out of the steaming station 30 and is shifted into a final sealing station 70 (FIG. 1) before being transferred to the discharge station 33 and the autoclave. When the pouch dwells at the station 70, a top seal of good quality is formed by a conventional impulse sealer comprising a sealing bar 71 and a backing bar 72, both bars being carried on rods 73 similar to the rods 45.

From the foregoing, it will be apparent that the present invention effects removal of air from the pouch 10 by mechanically creating a vacuum in the pouch while the pouch is being subjected to a flow of steam. When the pouch first moves into the steaming station 30 and as the vacuum nozzle 40 is being lowered, a shot of steam is injected into the pouch to drive some of the air out of the pouch. After the pouch has been mechanically sealed around the vacuum nozzle 40, the steam in the pouch is sucked into the vacuum nozzle and permits a more effective vacuum to be drawn through the nozzle and created within the pouch since the steam is less compressible than air. As the vacuum nozzle 40 is withdrawn from the pouch, the steam flowing downwardly from the steam nozzle 31 enshrouds the upper end of the pouch and prevents air from entering the pouch while the top seal is being formed. Any steam which is in the pouch after the seal is formed simply condenses. Thus, with the present invention, the sealed pouches have a very low air content even though the pouches are large in volume. Moreover, such pouches can be formed at high rates and with good repeatability.

While the pouches 10 have been specifically shown as being heat sealed in the steaming station 30, the initial heat sealing can take place in a downstream station. Since the clamps 13 and 14 hold the pouch closed after retraction of the vacuum nozzle 40, the pouch can be advanced out of the steaming station and to a downstream station (e.g., the station 70) for initial heat sealing without danger of any substantial air entering the pouch.

I claim:

1. A packaging machine for filling, evacuating and closing flexible pouches having open upper end portions, said machine comprising means for advancing the pouches open end up along a predetermined path, means for introducing product into each pouch, a nozzle, means for inserting said nozzle downwardly into each filled pouch, closing means operable to close the upper end portion of the pouch around said nozzle, means for drawing a vacuum through said nozzle to evacuate the air in the pouch, means for retracting said nozzle out of the pouch, said closing means holding the upper end portion of the pouch closed around said nozzle as the nozzle is retracted, means for continuously directing steam downwardly toward the upper end portion of the pouch at least from the time said nozzle is inserted into said pouch to a time subsequent to retraction of the nozzle out of the pouch, and means for closing the upper end portion of the pouch after retraction of the nozzle.

2. A packaging machine for filling, evacuating and sealing pouches having open upper end portions and each defined by two face-to-face flexible panels, said machine comprising mechanism for intermittently advancing the pouches open end up along a predetermined path and in ambient atmosphere through spaced filling and steaming stations with each pouch dwelling first in said filling station and then in said steaming station, a dispenser in said filling station for introducing product into each pouch while the latter dwells in said filling station, a steam nozzle located in said steaming station and above said path, means for introducing steam through said nozzle and into each pouch while the latter initially dwells in said steaming station and beneath said nozzle and for directing steam toward the pouch during the remainder of the dwell period, means for keeping the panels of each pouch spread away from one another to hold the upper end portion of the pouch in a widely open position while the pouch initially dwells beneath said nozzle thereby to enable the inroduction of said steam into said pouch, a vacuum nozzle movable upwardly and downwardly inside of said steam nozzle, means for inserting said vacuum nozzle downwardly into said pouch as the latter dwells beneath said steam nozzle and while the upper end portion of the pouch is held in a widely open position, closing means for thereafter closing the upper end portion of the pouch around said vacuum nozzle, means for drawing a vacuum through said vacuum nozzle to evacuate the air in the pouch, means for retracting said vacuum nozzle out of said pouch and upwardly within said steam nozzle, said closing means holding the upper end portion of the pouch closed as said vacuum nozzle is retracted, and means in said steaming station for sealing the upper end portion of the pouch immediately after retraction of said vacuum nozzle and before the pouch is advanced from beneath said steam nozzle thereby to prevent the introduction of air into the pouch.

3. A method of filling, evacuating and closing flexible pouches having open upper end portions, said method comprising the steps of advancing the pouches open end up along a predetermined path, introducing product into each pouch while holding the upper end portion of the pouch in an open position, inserting a nozzle downwardly into each filled pouch, closing the upper end portion of the pouch around the nozzle, drawing a vacuum through the nozzle to evacuate the air in the pouch, retracting the nozzle upwardly from the pouch while holding the upper end portion of the pouch around the nozzle, closing the upper end portion of the pouch immediately after retraction of the nozzle, and directing steam downwardly toward the upper end of the pouch continuously from a time prior to insertion of said nozzle to a time subsequent to closing of the pouch.

4. A method of filling, evacuating and sealing pouches having open upper end portions and each defined by two face-to-face flexible panels, said method comprising the steps of advancing the pouches open end up along a predetermined path and in ambient atmosphere through spaced filling and steaming stations, stopping each pouch first in said filling station and then in said steaming station, keeping the panels of each pouch spread away from one another to hold the upper end portion of the pouch in a widely open position while the pouch dwells in said filling station and while the pouch initially dwells in said steaming station, introducing product into each pouch while the pouch is dwelling in said filling station with its upper end portion held in said widely open position, introducing steam into each pouch through a steam nozzle while the pouch is initially dwelling in said steaming station and beneath said nozzle with the upper end portion of the pouch held in said widely open position and, while directing steam downwardly from said steam nozzle toward the pouch, performing the steps of (a) moving a vacuum nozzle downwardly within said steam nozzle and into the pouch dwelling beneath the steam nozzle, (b) moving the panels of the pouch toward one another to close the upper end portion of the pouch around said vacuum nozzle, (c) drawing a vacuum through said vacuum nozzle to evacuate the air in the pouch, (d) retracting the vacuum nozzle upwardly out of the pouch and within said steam nozzle while holding the upper end portion of the pouch closed around said vacuum nozzle and (e) sealing the upper end portion of the pouch immediately after retraction of the vacuum nozzle and before the pouch is advanced from beneath said steam nozzle thereby to prevent the introduction of air into the pouch.

* * * * *